US008593356B2

(12) United States Patent
Mierzwa et al.

(10) Patent No.: US 8,593,356 B2
(45) **Date of Patent: *Nov. 26, 2013**

(54) APPARATUS FOR MOUNTING A SATELLITE ANTENNA IN A TRUNK OF A VEHICLE

(75) Inventors: Kevin G. Mierzwa, Sylvan Lake, MI (US); Scott D. Casavant, Germantown, MD (US)

(73) Assignee: The DIRECTV Group, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/913,706

(22) Filed: Oct. 27, 2010

(65) Prior Publication Data

US 2011/0037669 A1 Feb. 17, 2011

Related U.S. Application Data

(63) Continuation of application No. 11/595,315, filed on Nov. 10, 2006, now Pat. No. 7,847,744.

(60) Provisional application No. 60/762,405, filed on Jan. 26, 2006.

(51) Int. Cl.
*H01Q 1/32* (2006.01)

(52) U.S. Cl.
USPC ..... 343/711; 343/713; 343/712

(58) Field of Classification Search
None
See application file for complete search history.

(56) References Cited

U.S. PATENT DOCUMENTS

| | | | | |
|---|---|---|---|---|
| 4,717,212 | A * | 1/1988 | Roberts | 312/21 |
| 4,758,166 | A * | 7/1988 | Bonnett et al. | 343/712 |
| 4,788,551 | A | 11/1988 | Ishida | |
| 4,845,505 | A | 7/1989 | Ohe et al. | |
| 4,866,453 | A | 9/1989 | Nagy et al. | |
| 5,018,781 | A | 5/1991 | Kumasaka et al. | |
| 5,402,134 | A | 3/1995 | Miller et al. | |
| 5,532,709 | A | 7/1996 | Talty | |
| 5,796,365 | A * | 8/1998 | Lewis | 342/357.25 |
| 5,918,183 | A * | 6/1999 | Janky et al. | 455/456.1 |
| 6,297,781 | B1 | 10/2001 | Turnbull et al. | |
| 6,338,526 | B1 | 1/2002 | Jardin et al. | |
| 6,417,810 | B1 | 7/2002 | Huels et al. | |
| 6,965,347 | B2 | 11/2005 | Sugimoto et al. | |
| 7,110,537 | B2 * | 9/2006 | Mazzara, Jr. | 379/437 |
| 7,149,481 | B2 * | 12/2006 | Okako et al. | 455/90.3 |
| 7,253,778 | B1 * | 8/2007 | Bingle et al. | 343/713 |
| 7,273,304 | B2 * | 9/2007 | Bischoff et al. | 362/496 |
| 7,408,909 | B2 * | 8/2008 | Trainin et al. | 370/338 |
| 7,472,409 | B1 * | 12/2008 | Linton | 725/76 |
| 7,847,744 | B2 * | 12/2010 | Mierzwa et al. | 343/713 |
| 2002/0126056 | A1 | 9/2002 | Zinsmeister et al. | |

(Continued)

FOREIGN PATENT DOCUMENTS

JP 3-128504 * 5/1991

OTHER PUBLICATIONS

The ARRL Antenna Book, Published by The America Radio Relay League puplished 1988; chapter 2, pp. 2-24 and 2-25.*

*Primary Examiner* — Trinh Dinh

(57) ABSTRACT

A vehicle includes a vehicle body having a trunk. The vehicle body has a deck lid covering the trunk. A satellite antenna is mounted within the trunk and is coupled to the deck lid. The deck lid includes a panel for transmitting a satellite signal therethrough and forms an entire exterior surface of the deck lid.

12 Claims, 3 Drawing Sheets

(56) References Cited

U.S. PATENT DOCUMENTS

| | | | | |
|---|---|---|---|---|
| 2002/0163219 | A1 | 11/2002 | Clark et al. | |
| 2003/0080908 | A1 | 5/2003 | Mizutani | |
| 2003/0159264 | A1 | 8/2003 | McLeod et al. | |
| 2004/0174312 | A1* | 9/2004 | Wiedmann et al. | 343/711 |
| 2004/0217906 | A1 | 11/2004 | Ishibayashi et al. | |
| 2006/0061145 | A1 | 3/2006 | Strebe et al. | |
| 2006/0220977 | A1 | 10/2006 | Ogino | |
| 2007/0087200 | A1 | 4/2007 | Batke et al. | |
| 2007/0217763 | A1* | 9/2007 | Siemens et al. | 386/112 |
| 2008/0001834 | A1* | 1/2008 | Yegin et al. | 343/713 |
| 2011/0215976 | A1* | 9/2011 | Clymer et al. | 343/705 |

* cited by examiner

APPARATUS FOR MOUNTING A SATELLITE ANTENNA IN A TRUNK OF A VEHICLE

CROSS-REFERENCE TO RELATED APPLICATIONS

This application is a continuation of U.S. patent application Ser. No. 11/595,315, filed Nov. 10, 2006, entitled "Apparatus for Mounting a Satellite Antenna in a Vehicle", now U.S. Pat. No. 7,847,744, which itself claims the benefit of the earlier filing date under 35 U.S.C. §119(e) of U.S. Provisional Application Ser. No. 60/762,405, filed on Jan. 26, 2006 entitled "Mounting of a Satellite Antenna within an Automotive Vehicle; the entireties of which are incorporated herein by reference.

TECHNICAL FIELD

The present disclosure relates to mobile reception of satellite television broadcasting, and, more specifically, to an apparatus for mounting an antenna within a vehicle.

BACKGROUND

The statements in this section merely provide background information related to the present disclosure and may not constitute prior art.

Satellite television has become increasingly popular due to its wide variety of programming. Entertainment in automobiles, such as DVD players, has also become increasingly popular. It would be desirable to provide a satellite television system for a vehicle so that a wide variety of programming may be enjoyed by the rear passengers.

Presently, satellite receiving antennas for vehicles are relatively large devices that are mounted on the outside of the rear structure of the vehicle. One disadvantage of mounting an antenna on the outside of the vehicles is that they are relatively large and, thus, somewhat unsightly. Wind noise and wind resistance are also factors on externally mounted antennas. Another disadvantage of antennas mounted on the exterior of the vehicle is that the antenna is subjected to extreme weather conditions including precipitation, wind and the like. Because of these factors, the antenna must be designed to robustly withstand the elements. This increases the cost of the antenna. Another disadvantage of an externally mounted antenna is that the antenna interferes with rooftop luggage storage or implementing storage or racks coupled to the roof rack of the vehicle.

It would, therefore, be desirable to provide an antenna that overcomes the above disadvantages of externally mounted antennas.

SUMMARY

The present invention relates to mounting of an antenna within the vehicle beneath the roof but above the headliner or under the deck lid using satellite transmissive material over the antenna and minimizing the intrusion of the antenna into the passenger compartment of the automotive vehicle.

One feature of the invention includes a vehicle body. A satellite antenna is mounted within the vehicle body. A satellite transmissive panel is coupled to the vehicle body adjacent to the antenna. The satellite antenna may be mounted within the passenger compartment or within the trunk of the vehicle.

The present invention allows the antenna to be mounted within the vehicle rather than outside of the vehicle. The present invention allows the antenna to be mounted within the automotive vehicle to prevent the antenna from becoming an unsightly part of the vehicle.

One advantage of the present invention is that it allows the antenna to be protected from the elements and thus the reliability of the antenna is increased. That is, the antenna components are protected from wind, rain, snow, ice and the like.

Another advantage of the invention is that the wind resistance of the vehicle is not increased by mounting the antenna within the vehicle. Any panel used may therefore be flush with the remaining roof portions. Additionally, the entire roof may be formed of satellite signal transmissive material.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
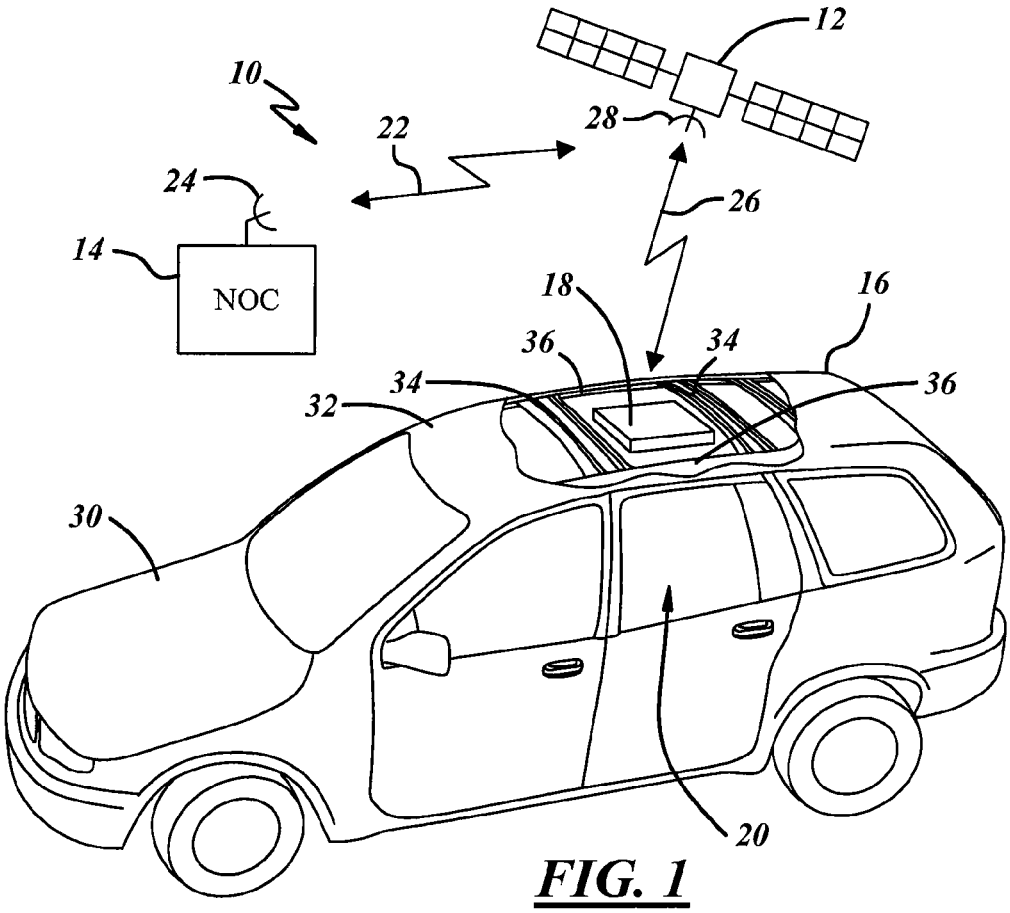
FIG. 1 is a perspective view of a satellite broadcasting system formed according to the present invention.

The following description is merely exemplary in nature and is not intended to limit the present disclosure, application, or uses. In the following figures, the same reference numerals will be used to illustrate the same components.

The present invention may be used for various types of satellite broadcasting including satellite television broadcasting. Of course, other satellite broadcasting uses may benefit from the teachings of the present disclosure.

Referring now to FIG. 1, a satellite broadcasting system 10 is illustrated having a satellite 12, a network operation center 14 and a vehicle 16 having an antenna 18 disposed therein. The vehicle 16 also has a passenger compartment therein. The network operation center 14 generates uplink signals 22 through an antenna 24 that are received by the satellite 12. The satellite 12 receives the uplink signals 22 and generates downlink signals 26 through antenna 28 that are received by antenna 18. Various types of uplink signals 22 may be generated at the network operation center, including video signals, audio signals and data signals. The downlink signals 22 thus correspond to the audio, video and data signals provided from the network operation center. The antenna 18 may also be used to uplink various signals through the satellite 12 which are then coupled to the network operation center 14. Various information and data such as a request for a Pay Per View program, security authorization or the like may be provided by generating signals from the antenna 18 and ultimately coupling them to the network operation center 14. As illustrated, the network operation center 14 is one unit. However, the network operation center 14 may be composed of various geographically-separated sites that are used to uplink various signals to the satellite.

The satellite antenna 18 may be various types of antennas including a rotating-type antenna, a phased array antenna, an omnidirectional antenna, or the like.

The vehicle 16 includes a vehicle body 30 that foil is the shell or exterior of the vehicle. The vehicle body 30 may include a roof 32, roof bows 34 that extend laterally across the vehicle, and side rails 36 that extend longitudinally across the vehicle. The roof bows 34 and side rails 36 may be formed of a material such as steel. The antenna 18 is disposed within the vehicle and may be disposed between various roof bows 34 and side rails 36. As will be described further below, the antenna 18 may be mounted directly to the roof bows 34, side rails 36, or disposed within a housing that is coupled to either the side rails, roof bows or other body structure.

As will be described below, the headliner may be used to hide the antenna within the passenger compartment 20 of the vehicle.

A portion of the vehicle body may be formed of satellite transmissive material or a satellite transmissive panel may be disposed over the antenna to enclose the antenna within the vehicle body. This will be described further below.

Figure 2:
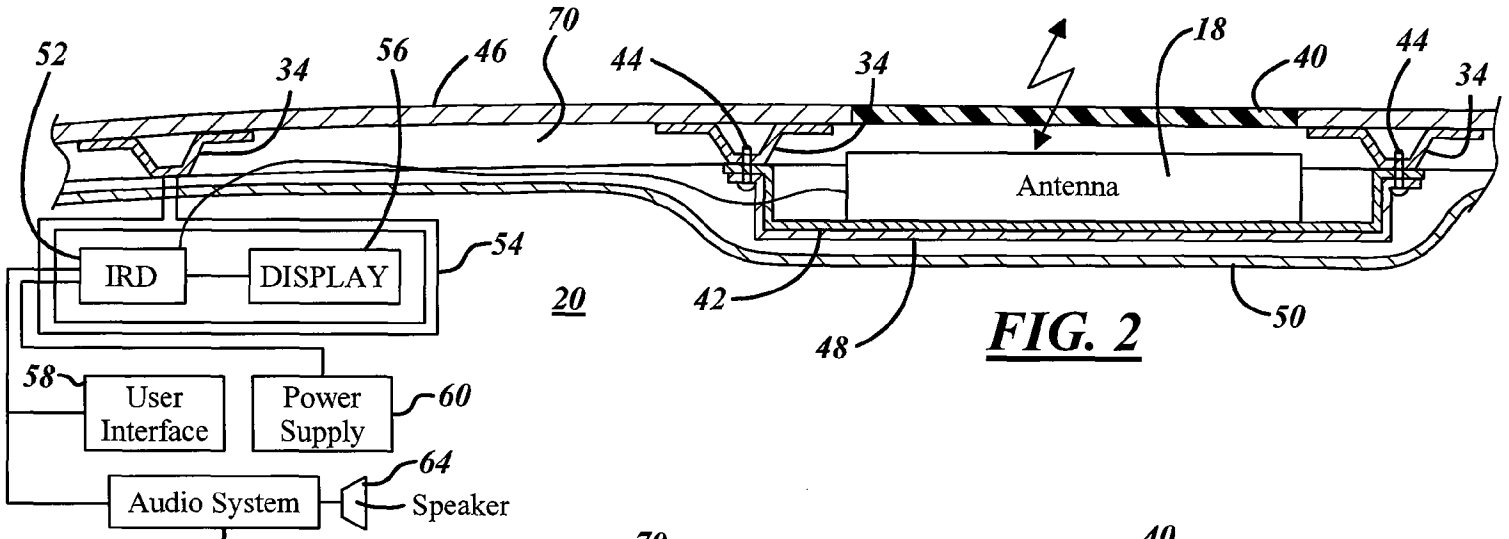
FIG. 2 is a cross-sectional view of one embodiment of the invention.

Referring now to FIG. 2, a satellite signal transmissive panel 40 is disposed over antenna 18. In this embodiment, a housing 42 is coupled to two consecutive roof bows 34. The roof bows 34 support the housing 42 with a fastener 44. The housing 42 may enclose or partially enclose the antenna 18 between the roof skin 46 and/or the satellite signal transmissive panel 40. Sound insulation 48 may be used to isolate sound from the movement mechanism of the antenna from the vehicle occupants. The sound insulation 48 is particularly useful in a rotating antenna which may have some noise associated with the motors and drive mechanism that drive the antenna.

A headliner 50 may be used to enclose the housing 42 and provide a finished look within the vehicle.

A satellite-receiving device 52 such as an integrated receiver decoder (IRD) may be disposed within the vehicle. The satellite-receiving device 52 may be enclosed within a housing 54 that is also mounted to a roof bow 34 or other vehicle structure. The housing 54 may also include a display 56. It should also be noted that the display 56 may be mounted in various positions within the vehicle, including the headrests, sun visors or the like.

The receiving device 52 may also include a user interface 58 coupled thereto along with a power supply 60 and an audio system 62 having at least one speaker 64. The user interface 58 may include various types of interfaces including a remote control, buttons located with the receiving device or buttons associated with the audio system of the vehicle.

It should be noted that in FIG. 2, the housing 42 may also be coupled to a side rail 70. Thus, both the side rail 70 and the roof 46 may be used together or individually to support a housing that receives the antenna 18 therein.

The material that the satellite signal transmissive panel 40 is made from may include various types of materials such as a plastic material. Because the system may be used in a roof, the system is preferably rigid so that it may easily replace the metal material. It should also be noted that the entire roof 46 or just a portion of the roof 46 may be made from the material. That is, enough structure from the roof bows and side rails may be provided on the vehicle so that a satellite transmissive material may be used. One vehicle having a portion of the roof made of a plastic material is the Volvo XC90 which includes a small portion of the roof formed from a plastic material. It should also be noted that the roof panel is preferably flush with the rest of the roof skin 46 so that wind noise and sealing problems are reduced. Of course, gaskets, grommets, or other materials may be used to provide a seal at the satellite-signal transmissive panel 40.

Figure 3:
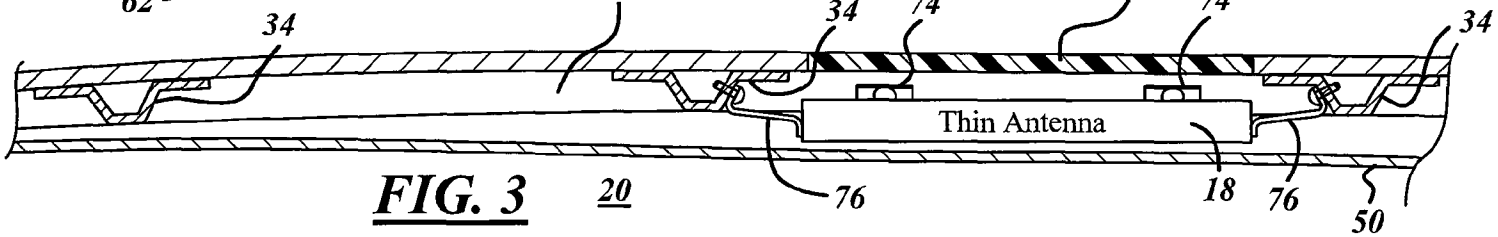
FIG. 3 is a cross-sectional view of another embodiment of the invention.

Referring now to FIG. 3, a number of brackets are used to mount the antenna to either the roof bow, the roof side rail, or both. Thus, in this embodiment, the headliner 50 remains flush and the antenna 18 remains between the roof bows. Side rail brackets 74 and row bow brackets 76 may be used individually or together to mount the antenna 18 to the respective side rail or roof bow. Depending on the configuration of the antenna 18, the headliner 50 may actually extend slightly inward to the passenger compartment to accommodate the extra thickness of the antenna. The antenna in this figure is shown without a housing. However, the housing may be mounted using all or some of the brackets 74 illustrated.

Figure 4:
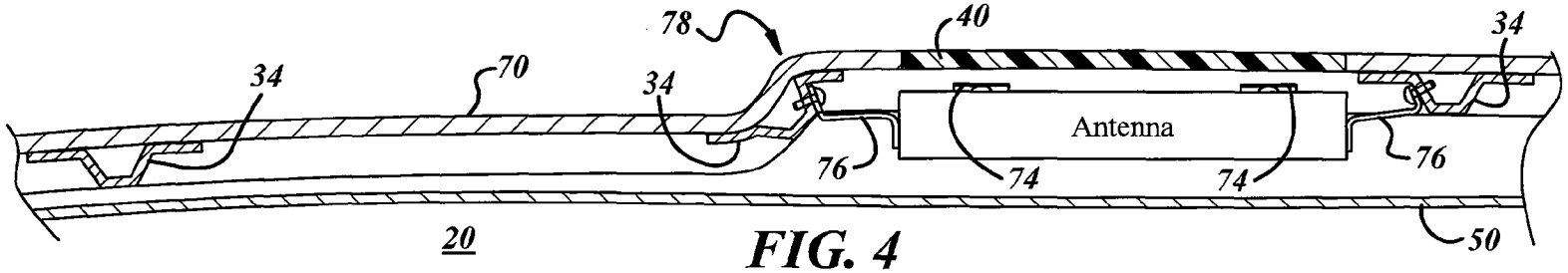
FIG. 4 is a cross-sectional view of yet another embodiment of the invention.

In FIG. 4, the roof 46 may also have a step portion 78 that extends higher than the rest of the roof. The Ford Freestyle crossover utility vehicle includes such a step portion 78. In the case of the Freestyle, the step portion increases the head room of the third row of passengers. In this embodiment, the headroom may remain the same while allowing the extra space to accommodate the antenna therein. This will allow the headliner 50 to remain flush with the other portions of the headliner 50.

Figure 5:
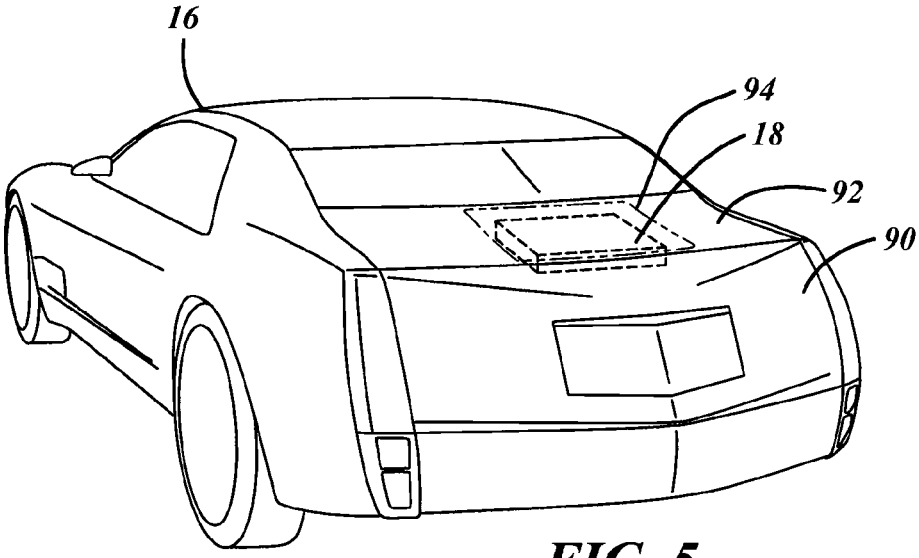
FIG. 5 is a perspective view of a vehicle having an antenna mounted within the vehicle.

In FIG. 5, the antenna 18 may be coupled within a trunk 90 of an automotive vehicle 16. In this embodiment, the antenna 18 may be mounted beneath a deck lid or trunk door 92 of the vehicle 16. An antenna panel 94 is used as the finished surface so that satellite signals may be transmitted therethrough.

Figure 6:
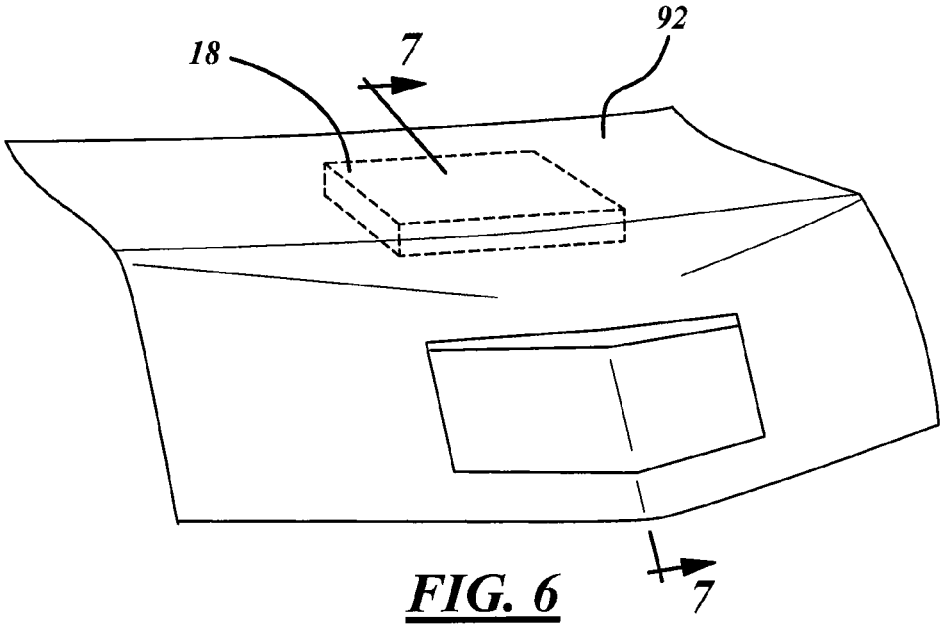
FIG. 6 is a perspective view of an alternative embodiment to that of FIG. 5.
Figure 7:
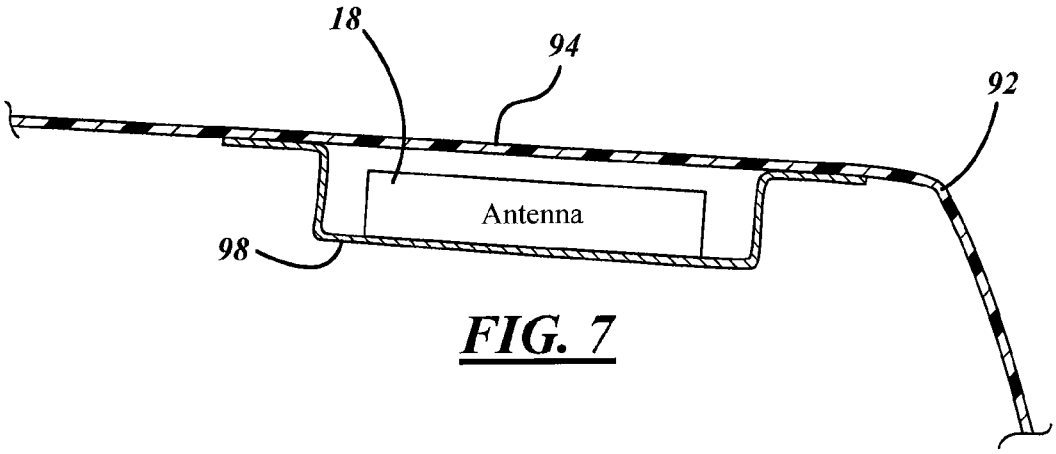
FIG. 7 is a cross-sectional view of the deck lid of FIG. 6.

In FIGS. 6 and 7, the deck lid 92 may be entirely made of satellite transmissive material and the antenna 18 may be placed under the deck lid 92. It is envisioned that the antenna will remain relatively thin and thus intrude little into the cargo space of the trunk of the vehicle. The antenna 18 may be disposed within a housing 98 mounted to the deck lid or support structure associated with the deck lid. Of course, sound insulation may also be provided on the outside of the housing if the antenna is mechanically noisy.

While particular embodiments of the invention have been shown and described, numerous variations and alternate embodiments will occur to those skilled in the art. Accordingly, it is intended that the invention be limited only in terms of the appended claims.

What is claimed is:

1. A vehicle comprising:

a vehicle body having a trunk, said vehicle body comprising a deck lid covering the trunk of the vehicle;

a satellite antenna mounted within the trunk and coupled to the deck lid; and said deck lid comprising a panel for transmitting a satellite signal therethrough forming an entire exterior surface of the deck lid.

2. A vehicle as recited in claim 1 further comprising a housing mounted to the deck lid.

3. A vehicle as recited in claim 2 further comprising sound insulation disposed on the housing.

4. A vehicle as recited in claim 2 wherein the antenna is mounted between the housing and the panel.

5. A vehicle as recited in claim 1 further comprising a housing mounted to support structure associated with the deck lid.

6. A vehicle as recited in claim 1 further comprising a satellite receiver coupled to the antenna and a display coupled to the satellite receiver.

7. A vehicle as recited in claim 6 wherein the satellite receiver is coupled to the vehicle body.

8. A vehicle as recited in claim 6 wherein the satellite receiver is coupled within a passenger compartment of the vehicle body.

9. A vehicle as recited in claim 6 wherein the display is coupled within a passenger compartment of the vehicle.

10. A vehicle as recited in claim 1 wherein the satellite antenna comprises an omni-directional antenna.

11. A vehicle as recited in claim 1 wherein the satellite antenna comprises a rotating-type antenna.

12. A vehicle as recited in claim 1 wherein the satellite antenna comprises a phased-array antenna.

* * * * *